US010264833B2

(12) United States Patent
Eleish et al.

(10) Patent No.: US 10,264,833 B2
(45) Date of Patent: Apr. 23, 2019

(54) GARMENT WITH REWRITABLE AREAS

(71) Applicant: Regwez, Inc., Foster City, CA (US)

(72) Inventors: Ragy Eleish, Foster City, CA (US); Sulaiman Hyatt, Oakland, CA (US); Abdelrahman Eleish, Foster City, CA (US)

(73) Assignee: REGWEZ, INC., Foster City, CA (US)

( * ) Notice: Subject to any disclaimer, the term of this patent is extended or adjusted under 35 U.S.C. 154(b) by 187 days.

(21) Appl. No.: 15/283,100

(22) Filed: Sep. 30, 2016

(65) Prior Publication Data

US 2017/0095021 A1 Apr. 6, 2017

Related U.S. Application Data

(60) Provisional application No. 62/236,759, filed on Oct. 2, 2015.

(51) Int. Cl.
*B43L 1/00* (2006.01)
*A41D 27/08* (2006.01)
(Continued)

(52) U.S. Cl.
CPC ..... *A41D 27/08* (2013.01); *A41B 1/00* (2013.01); *B41F 15/00* (2013.01); *B43L 1/002* (2013.01); *A41D 2500/54* (2013.01)

(58) Field of Classification Search
USPC .... 434/81, 84, 85, 87, 96, 98, 99, 100, 408, 434/413, 427; 2/69, 209.13; 101/129
See application file for complete search history.

(56) References Cited

U.S. PATENT DOCUMENTS 4,627,110 A * 12/1986 Tengs ..... A41D 1/04 2/115
4,978,568 A * 12/1990 Postma ..... B43L 1/08 428/187

(Continued)

FOREIGN PATENT DOCUMENTS

EP 0142257 A2 12/1987
EP 0416888 A2 1/1996

OTHER PUBLICATIONS

International Preliminary Report on Patentability for corresponding PCT Application No. PCT/US2016/055010, dated Apr. 12, 2018, in 12 pages.

(Continued)

*Primary Examiner* — Kurt Fernstrom
(74) *Attorney, Agent, or Firm* — Noel C. Gillespie; Procopio, Cory, Hargreaves & Savitch LLP

(57) ABSTRACT

A garment having an outer surface not designed for writing has at least one rewritable area comprising a layer of rewritable material deposited directly onto a selected region of the outer surface. One or more permanent artworks may be deposited onto the garment prior to deposit of the rewritable layer, which may be contiguous or non-contiguous. A stencil is provided for allowing a user to write on rewritable areas while protecting adjacent areas of the garment. In one method for forming the rewritable area, a first portion of a permanent artwork and a second portion of the permanent artwork are successively deposited on the garment, followed by curing the permanent artwork and depositing a rewritable area on the garment.

15 Claims, 4 Drawing Sheets

(51) Int. Cl.
*A41B 1/00* (2006.01)
*B41F 15/00* (2006.01)

(56) References Cited

U.S. PATENT DOCUMENTS 5,253,368 A * 10/1993 Blake ..... A42B 1/248 2/195.1
6,421,832 B1 7/2002 Ondrejko
6,982,115 B2 * 1/2006 Poulos ..... A41D 27/08 156/230
7,901,213 B1 * 3/2011 Beno ..... B43K 23/001 434/408
8,556,637 B2 * 10/2013 Domey ..... B43L 1/008 434/408
9,150,747 B2 * 10/2015 Schilo ..... A43B 1/0027
9,227,459 B2 * 1/2016 Goscha ..... B43L 1/00
2008/0086793 A1 * 4/2008 Higgins ..... A42B 1/248 2/209.13
2009/0013447 A1 * 1/2009 Drosihn ..... A42B 1/068 2/209
2009/0152154 A1 * 6/2009 Coyne ..... A45C 3/04 206/459.5
2009/0158490 A1 * 6/2009 White ..... A41D 27/08 2/69
2009/0280716 A1 11/2009 Normand
2010/0064915 A1 * 3/2010 Skarpetis ..... A41D 27/08 101/129
2011/0086335 A1 4/2011 Rogers
2012/0167273 A1 * 7/2012 Ballinger ..... A41D 19/0024 2/160
2012/0167285 A1 * 7/2012 Oppenheim ..... A42B 3/06 2/414
2015/0096108 A1 * 4/2015 Almeda, Jr. ..... A41D 27/08 2/244
2015/0104779 A1 * 4/2015 Kingston ..... B43L 1/008 434/409
2015/0158325 A1 * 6/2015 Pineiro ..... B43L 1/00 434/408
2015/0327613 A1 * 11/2015 Kay ..... A42B 1/245 2/209.13
2016/0128453 A1 * 5/2016 Beard ..... A45F 3/20 434/408
2016/0203743 A1 * 7/2016 Crigler ..... A63B 69/0071 434/408

OTHER PUBLICATIONS

International Search Report and Written Opinion for corresponding PCT Application No. PCT/US2016/055010, dated Jan. 6, 2017, in 15 pages.

* cited by examiner

GARMENT WITH REWRITABLE AREAS

RELATED APPLICATIONS INFORMATION

This application claims the benefit under 35 U.S.C. 119(e) to Provisional Patent Application No. 62/236,759, filed on Oct. 2, 2015, which is incorporated herein by reference in its entirety as if set forth in full.

BACKGROUND

1. Technical Field

The various embodiments described herein are related to textile manufacturing and post-manufacturing processes, and more specifically to a garment with rewritable areas.

2. Related Art

Printed garments (e.g., t-shirts, hats, jackets, sweaters, etc.) are ubiquitous. For example, printed t-shirts and baseball caps serve as casual uniforms at many venues, sell as tremendously lucrative souvenir items, and are a perennially popular novelty gift. However, conventional garments are shipped and sold with fixed patterns and designs. Even a garment that was printed or embroiled according to a consumer's specifications cannot be changed afterwards. Similarly, embellishments rendered using permanent fabric markers are equally resistant to subsequent modifications whereas washable pens deliver dull colors and poorly defined designs.

What is needed is a garment that can accommodate repeatedly changing designs or patterns.

SUMMARY

A garment with writable or rewritable areas and a method for forming a writable or rewritable area on a garment are provided.

According to various embodiments, there is provided a garment with one or more rewritable areas which allow indicia to be written on the rewritable areas and later changed by wiping or washing the garment to allow different indicia to be written on the rewritable areas. The garment may also include permanent artwork. In various embodiments, the permanent artwork is integrated with one or more rewritable areas.

According to various embodiments, there is provided a method for forming a rewritable area on a garment. The method may include: depositing a first portion of a permanent artwork on the garment; depositing a second portion of the permanent artwork on the garment; curing the permanent artwork; and depositing a rewritable area on the garment.

Other features and advantages of the present inventive concept should be apparent from the following description which illustrates by way of example aspects of the present inventive concept.

BRIEF DESCRIPTION OF THE DRAWINGS

The above and other aspects and features of the present inventive concept will be more apparent by describing example embodiments with reference to the accompanying drawings, in which.

DETAILED DESCRIPTION

While certain embodiments are described, these embodiments are presented by way of example only, and are not intended to limit the scope of protection. The methods and systems described herein may be embodied in a variety of other forms. Furthermore, various omissions, substitutions, and changes in the form of the example methods and systems described herein may be made without departing from the scope of protection.

According to various embodiments, a garment such as a T-shirt, tank top, or other type of casual attire includes at least one writable or rewritable area and may include two or more rewritable areas. In some embodiments, the garment can further include one or more permanent artworks, which may be rendered using one or more printing and/or embroiling techniques (e.g., screening, heat press transfer, dye sublimation, Jacquard weaving or knitting the permanent art, hand weaving or knitting the permanent art, or the like).

In various embodiments, a consumer can personalize the rewritable area by using one or more erasable markers, crayons, pens, colored pencils or the like to create any desired design, pattern, words and/or motif in the rewritable area. The rewritable area may be in any color, shape, and configuration. For example, the rewritable area can be any regular shape (e.g., rectangle) or irregular shape and may be contiguous or non-contiguous. In some embodiments, a consumer can personalize the rewritable area using a stencil corresponding to the shape of the rewritable area, as described in more detail below. Applying the stencil may confine any personalization to within the rewritable area and prevent inadvertent staining of material outside of the rewritable area.

In one exemplary embodiment, contents (e.g., design, pattern, and/or motif) in the rewritable area are not permanent. Advantageously, the consumer can repeatedly alter the design, pattern and/or motif included in the rewritable area while keeping the same garment. For example, some or all of the design, pattern, and/or motif may be removed by washing the garment and/or wiping the rewritable area (e.g., using a damp cloth).

Figure 1:
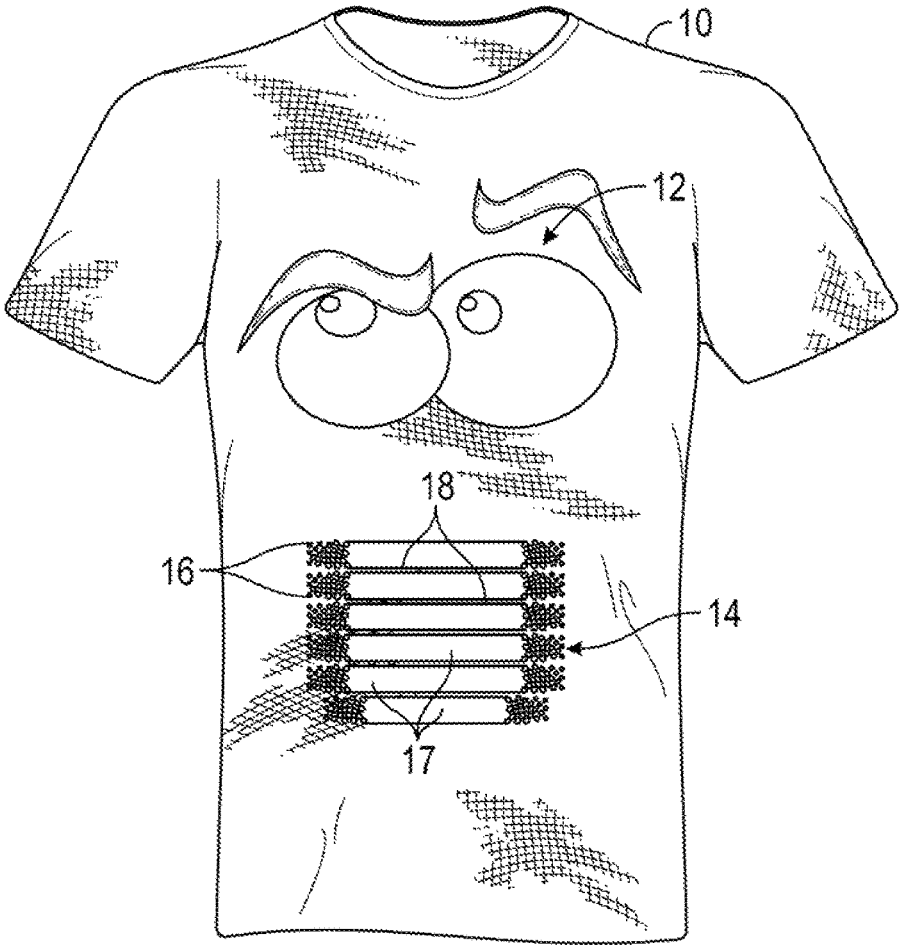
FIG. 1 is a front elevation view of one embodiment of a garment with a writable area.

FIG. 1 illustrates a garment 10 according to various embodiments. The garment 10 in the illustrated embodiment is a T-shirt, but other types of garment or clothing accessory may be provided with one or more rewritable areas in alternative embodiments, such as collared shirts, dresses, jackets, ties, scarves, shorts, and the like. Rewritable areas may be provided on the front or back of a garment, or on the front and back, as well as other parts of the garment. Referring to FIG. 1, in various embodiments, the garment 10 includes a rewritable area 14. In various embodiments, the rewritable area 14 can be any shape, color, and configuration. For example, the rewritable area 14 can be any regular or irregular shape. The rewritable area can further include any visual features including, for example, but not limited to, halftone edges 16, which simulates a gradient using varying densities of a single solid color.

The garment 10 may further include at least one permanent artwork including, for example, but not limited to, a permanent artwork 12. In some embodiments, the permanent artwork 12 may be separate from the rewritable area 14. According to one exemplary embodiment, the permanent artwork 12 may be incorporated in a rewritable area, as discussed in more detail below with reference to FIGS. 3 and 4. For example, the permanent artwork 12 may coordinate with the rewritable area 14 aesthetically and/or thematically.

In some embodiments, the rewritable area 14 can be non-contiguous, as illustrated by way of example in FIG. 1. In some embodiments, the rewritable area 14 may be separated by one or more gaps 18. In the embodiment of FIG. 1, the rewritable area 14 comprises a series of writable horizontal rectangles or bars 17 separated by gaps 18, located on unprinted portions of the garment. The rewritable area is shown on the front of the garment in FIG. 1, but may be located on the back of the garment in other embodiments, or rewritable areas may be located on both the front and rear of the garment and in other areas (e.g. sleeves). In various embodiments, the one or more gaps 18 may include printed (e.g., at least a portion of the permanent artwork 12) and/or unprinted portions of the garment 10. Advantageously, the inclusion of the one or more gaps 18 can be an aesthetic feature. Moreover, the one or more gaps 18 may provide breathability. The shape, size, and color of the rewritable area may be varied in different embodiments.

In some embodiments, the rewritable area 14 can be formed by depositing a layer of vinyl or polyurethane (PU) directly on the material of garment 10 using a heat press, silk-screening, or the like. In some embodiments, the deposited layer is a thin layer having a thickness of 100 micron or less. The garment 10 may be constructed from any suitable material or fabric including, for example, but not limited to, cotton (e.g., 100% cotton), cotton blends (e.g., 60% cotton), other natural fabrics such as wool, cashmere, silk, linen and the like, semi-natural fabrics such as rayon or the like, and composite fabrics such as tri-blend. These fabrics are absorbing. The garment may also be constructed from non-absorbing fabrics such as SPANDEX® or elastane fiber, or other natural fibers treated to repel water. Such fabrics typically have a surface texture as a result of the fabric manufacturing method, typically knitting, weaving or sewing. When a thin layer of vinyl is deposited on a garment surface, it naturally adopts the texture of the underlying material of garment 10. If the thickness of the writable layer or the nature of the underlying material texture is such that the layer does not naturally adopt the desired texture, texturing can be applied to the surface of layer immediately after it is deposited in any suitable manner. The micro-texture that is created on the surface of the PU layer affords sufficient friction for the ink from erasable markers or the like both to adhere to the layer and to deliver vibrant colors.

Alternatively, in some embodiments, the rewritable area 14 can be fashioned by depositing a thick polyvinyl chloride (PVC) or polyurethane (PU) layer on the garment 10, i.e. a layer having a thickness of more than 100 microns, for example 110 microns or more. A thick layer can yield a slick surface that may be compatible with washable crayons and can be cleaned with off-the-shelf dry erasers.

In some embodiments, the rewritable area 14 can be formed by depositing ink (e.g., silk screening) on a finely weaved and non-absorbent material including, for example, but not limited to, polyester and polyester blends. The ink layer can maintain markings made by erasable markers in a similar fashion to a PU or a PVC layer. In some embodiments, the rewritable area 14 may be sewn or glued to the garment.

In some embodiments, the rewritable area 14 may be formed by depositing a layer of suitable rewritable material such as polyvinyl chloride or polyurethane using a heat press.

Figure 2:
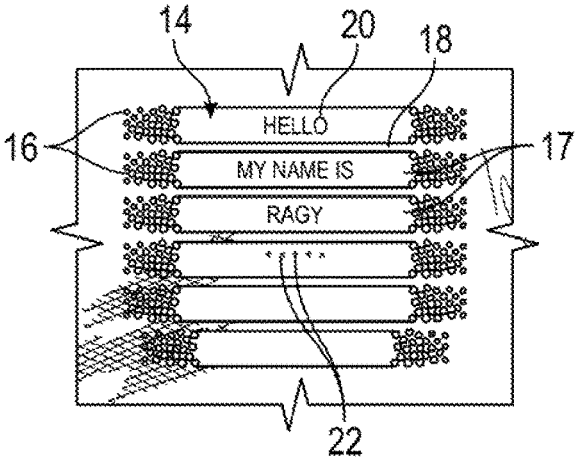
FIG. 2 is an enlarged view of part of the front of the garment illustrating one example of indicia written on the writable area of the garment of FIG. 1 by a user.

FIG. 2 illustrates the rewritable area 14 of FIG. 1 on a larger scale, with one example of words 20 and other symbols, drawings, or indicia 22 which may be hand-written or marked in the horizontal writing block areas 17 which simulate lines in a document.

Figure 3:
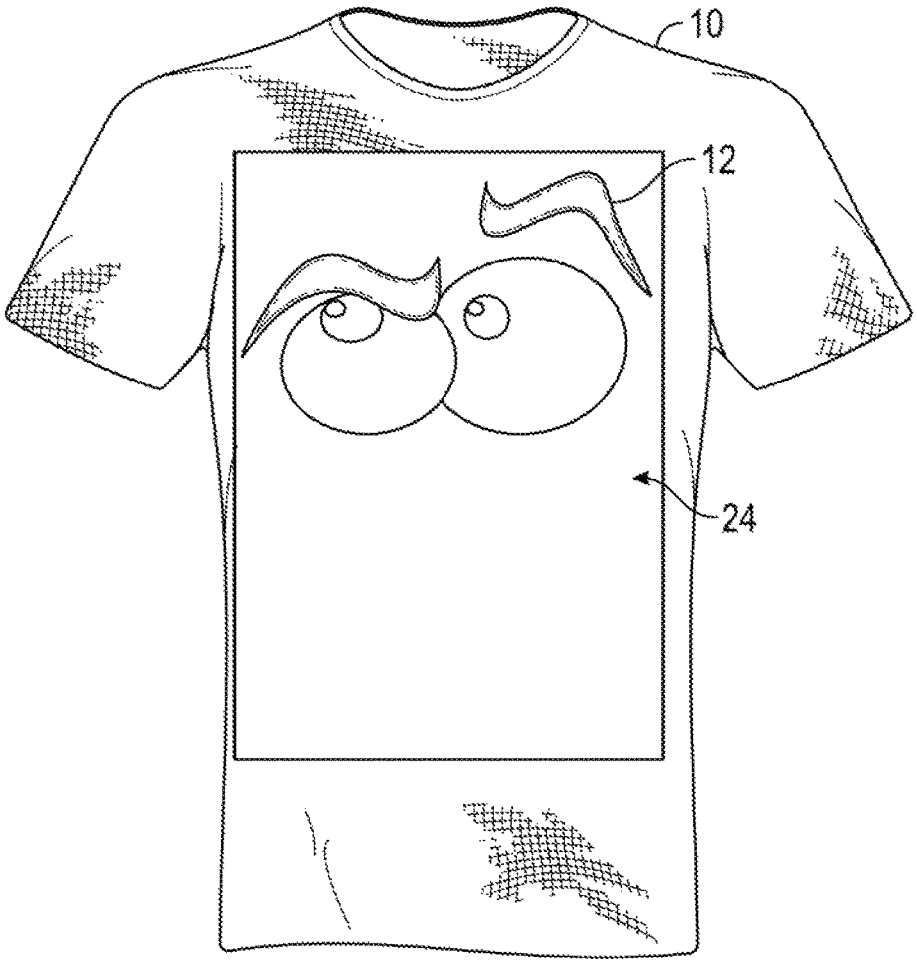
FIG. 3 is a front elevation view of another embodiment of a garment with a writable area.

FIG. 3 illustrates another embodiment of the garment 10 with permanent artwork 12 located within a larger rewritable area 24. This allows a user to draw objects, write words, or the like in the large rewritable area under artwork 12. For example, the user may draw the remainder of a face below the eyes such as a mouth and nose. It will be understood that the permanent artwork 12 in the form of stylized eyes is just one example and any other permanent artwork may be placed at any location inside or outside one or more writable areas on a garment in other embodiments, or the garment may include only one or more writable areas and no permanent artwork.

Figure 4:
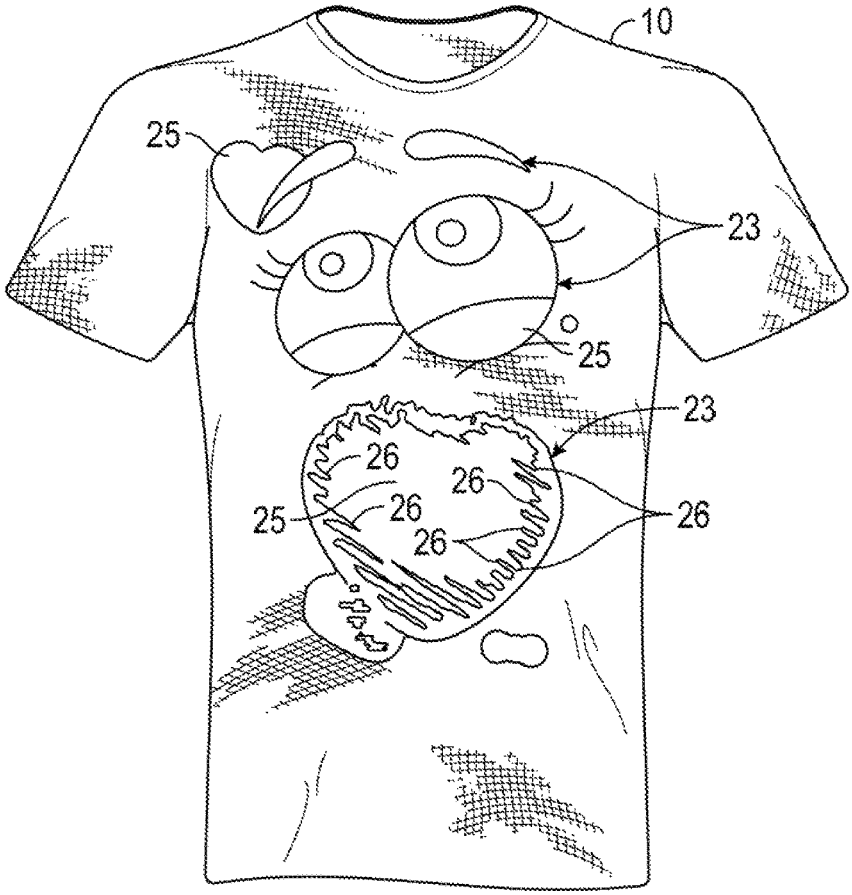
FIG. 4 is a front elevation view of another embodiment of a garment with a writable area.

Referring to FIG. 4, in some embodiments, the garment 10 can include multiple areas overlaid with imprinted or deposited permanent artwork 23 (or any other permanent artwork designs provided in any suitable manner) and multiple rewritable areas 25. One or more gaps or spaces 26 not covered with the rewritable layer material are provided in the multiple rewritable areas as visual features and/or to provide breathability, similar to gaps 18 in FIGS. 1 and 2 where the underlying material of the garment is exposed. As shown in FIG. 4, in some embodiments, at least some of the multiple rewritable areas and portions thereof may be an overlay atop at least a portion of the permanent artwork 23, forming a part of the artwork itself. This allows the user to color selected regions of the artwork 23 as desired, or to place other indicia or markings within the artwork.

Figure 5:
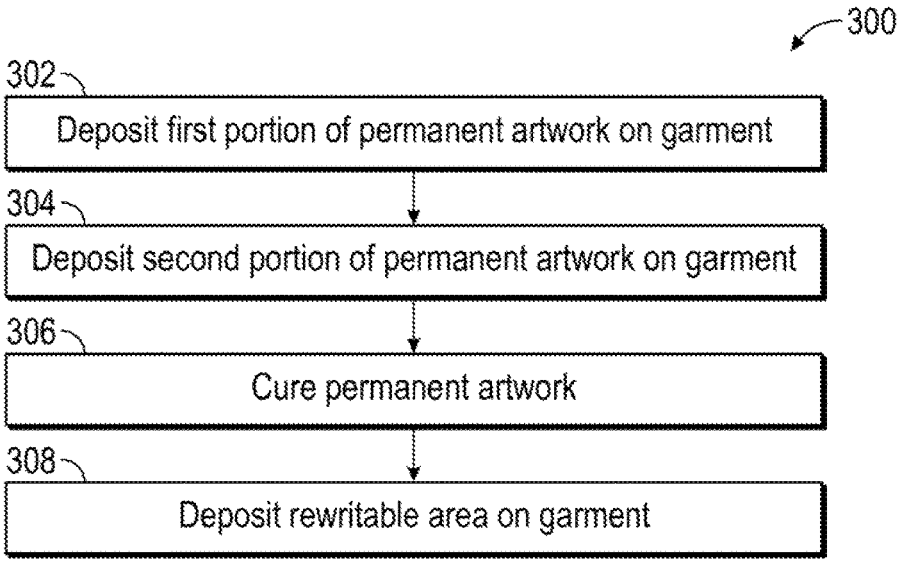
FIG. 5 is a flowchart illustrating a process for forming a rewritable area on a garment according to various embodiments.

FIG. 5 is a block diagram illustrating a process 300 for forming a rewritable area on a garment according to various embodiments, such as the rewritable areas of FIGS. 1 to 4 or rewritable areas of other peripheral shapes and designs in alternative embodiments.

A first portion of the permanent artwork 12 is deposited on the garment 10 (302). For example, in some embodiments, a primary portion (e.g., outline) of the artwork 12, 23 may be printed on the garment 10 using a specially formulated ink.

A second portion of the permanent artwork 12, 23 is deposited on the garment 10 (304). For example, in some embodiments, a secondary portion (e.g., details) of the permanent artwork 12 may be printed using a plastisol ink.

The permanent artwork 12, 23 is then cured (306) and one or more rewritable areas are deposited on the garment 10 (308) in one of the manners described above. In some embodiments, the rewritable area may be deposited on an unprinted portion of the garment completely separate from the permanent artwork 12, 23. Alternately, in some embodiments, at least a portion of the rewritable area may be an overlay atop at least a portion of the permanent artwork 12, 23.

In some embodiments, the rewritable area may be formed a proprietary vinyl paper that is applied to the garment 10 using a heat press. The heat press may be properly aligned based on at least one of the first portion and second portion of the permanent artwork 12. Alternately, in some embodiments, the rewritable area 14 can be a thin or thick PVC or polyurethane layer or ink that is deposited on the garment 10.

A person having ordinary skill in the art can appreciate that one or more operations of the process 300 may be repeated, omitted, and/or performed in a different order without departing from the scope of the present disclosure.

Figure 6:
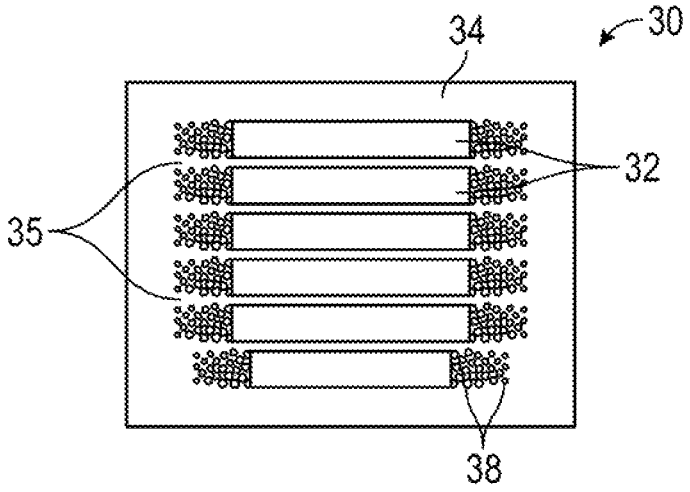
FIG. 6 is a top plan view of a stencil providing a guide for writing on a matching rewritable area on a garment according to various embodiments.
Figure 7:
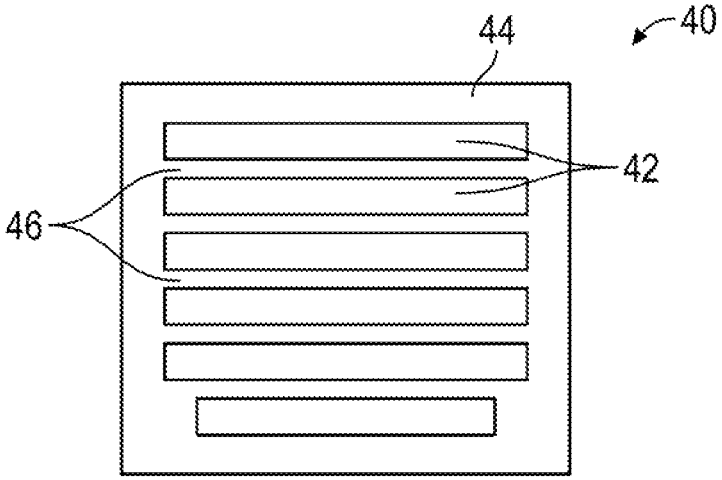
FIG. 7 is a top plan view of a modified stencil for writing on a modified rewritable area on a garment according to various embodiments.

FIGS. 6 and 7 illustrate embodiments of a stencil 30, 40 which may be used in conjunction with a rewritable area on a garment, such as area 14 of FIG. 1 or other rewritable area designs, according to various embodiments. The stencil has openings which correspond to the shape of the rewritable area with which it is to be used. Referring to FIGS. 1, 2 and 6, the stencil 30 has openings which correspond to the shape of the rewritable areas described with respect to FIGS. 1 and 2.

As shown in the FIG. 4, the stencil 30 includes a sheet or panel 34 of solid material (e.g., plastic or silicone) which substantially forms a reverse or negative of the shape of the non-contiguous rewritable areas in region 14 of FIGS. 1 and 2. The stencil 20 has rectangular openings 32 for alignment with the rewritable, strip-like areas 17 in FIG. 2, with solid, narrow linear strips 35 of panel 34 extending between adjacent openings 32. Half-tone holes 38 are provided in the panel around the ends of openings 32 to allow ink (e.g., from erasable markers) to be transferred to the half-tone dots or circles 16 of rewritable area 14. The linear strips 35 cover the gaps 18 when the stencil is placed over the rewritable area 14 of FIG. 1, and have substantially the same dimensions as the gaps 18 in the rewritable area 14. The half-tone holes 38 allow ink (e.g., from erasable markers) to reach only the half tone dots 16. When stencil 30 is positioned over re-writable area 14 on shirt 10, the user may write or draw on strips 35 with markers, pens, crayons or the like with little or no risk of ink staining adjacent areas of the garment. It will be understood that similar stencils may be provided with different opening designs to match various designs of re-writable areas on garments.

FIG. 7 illustrates another stencil 40 according to various embodiments. Stencil is similar to the stencil 30 of FIG. 6, but in this embodiment the half-tone holes 38 are eliminated, and openings 42 correspond to re-writable areas or boxes similar to boxes 17 of FIG. 2 but for use with a different rewritable area which has only strips or boxes 17 with no half-tone dots at the ends of boxes 17.

As in FIG. 6, stencil 40 includes solid material 44, which can be opaque or transparent. The solid material 44 reduces the risk of ink (e.g., from erasable markers) from reaching and potentially staining the garment 10. The stencil 20 further include box-like or rectangular openings 42 that allow ink (e.g., from erasable markers) to transfer to at least a portion of the rewritable area 14. In this embodiment, the lines 26 that cover the gaps 18 are thicker than gaps 18 in order to accommodate fabric stretching during and after the printing process. Advantageously, the stencil 40 reduces the rewritable area 14 to further reduce the risk of staining the fabric of the garment 10 when a user writes in areas 17.

In one embodiment, garments with one or more rewritable areas as described in connection with the above embodiments may be provided in kits or assemblies including the garment, one or more stencils with openings matching the rewritable area or areas on the garment, and marking devices in different colors suitable for writing on the rewritable area, such as erasable markers, crayons, pens, or colored pencils or the like.

The accompanying claims and their equivalents are intended to cover such forms or modifications as would fall within the scope and spirit of the protection. The foregoing method descriptions and the process flow diagrams are provided merely as illustrative examples and are not intended to require or imply that the steps of the various embodiments must be performed in the order presented. As will be appreciated by one of skill in the art the order of steps in the foregoing embodiments may be performed in any order. Words such as "thereafter," "then," "next," etc. are not intended to limit the order of the steps; these words are simply used to guide the reader through the description of the methods. Further, any reference to claim elements in the singular, for example, using the articles "a," "an" or "the" is not to be construed as limiting the element to the singular.

Although the present disclosure provides certain example embodiments and applications, other embodiments that are apparent to those of ordinary skill in the art, including embodiments which do not provide all of the features and advantages set forth herein, are also within the scope of this disclosure. Accordingly, the scope of the present disclosure is intended to be defined only by reference to the appended claims.

What is claimed is:

1. A re-writable garment assembly, comprising:

an item of clothing or accessory of a first material having an outer surface not designed for writing and at least one rewritable area comprising a layer of rewritable material different from the first material deposited directly onto a selected region of the outer surface; and a stencil adapted for use when writing on the rewritable area and comprising a layer of solid material having one or more openings substantially corresponding in size and shape to the rewritable area, the stencil being configured to extend over and shield areas of the first material adjacent to the rewritable area.

2. The garment of claim 1, wherein the at least one rewritable area is deposited by a heat press or silk-screening.

3. The garment of claim 1, further comprising at least one permanent artwork on the outer surface.

4. The garment of claim 3, wherein at least a portion of the at least one rewritable area is an overlay on top of at least a portion of the permanent artwork.

5. The garment of claim 4, further comprising at least one additional rewritable area separate from the permanent artwork and comprising a second layer of rewritable material deposited directly onto a selected different region of the outer surface.

6. The garment of claim 1, wherein the rewritable material is selected from the group consisting of polyvinyl chloride (PVC) and polyurethane vinyl (PU) and is deposited onto the outer surface by a heat press transfer or silk-screening.

7. The garment of claim 6, wherein the outer surface of the garment has a surface texture and the deposited layer is a thin layer of rewritable material having a thickness not greater than 100 microns which adopts the surface texture of the garment when deposited onto the outer surface.

8. The garment of claim 6, wherein the outer surface of the garment has a surface texture and the deposited layer is a layer of rewritable material having a thickness greater than 100 microns which does not adopt the surface texture of the garment when deposited onto the outer surface.

9. The garment of claim 1, wherein the layer is non-contiguous and the at least one rewritable area includes non-contiguous layer portions separated by uncovered regions of the garment.

10. The garment of claim 1, wherein the garment comprises cotton or a cotton-blend material.

11. The garment of claim 1, wherein the first material comprises a non-absorbent material.

12. The garment of claim 11, wherein the non-absorbent material comprises polyester or a polyester blend.

13. The garment of claim 11, wherein the rewritable area is formed by depositing ink on the garment.

14. The garment of claim 1, wherein the at least one rewritable area includes at least one gap.

15. The assembly of claim 1, wherein the rewritable area is non-contiguous and comprises a series of rewritable regions separated by exposed areas of the outer surface of the garment, and the stencil has openings corresponding to the rewritable regions, a first solid portion surrounding the rewritable area and second solid portions extending between adjacent rewritable regions, the second solid portions having a width equal to or greater than the width of the exposed areas between adjacent rewritable regions.

* * * * *